US010304411B2

(12) United States Patent
Aflatooni et al.

(10) Patent No.: US 10,304,411 B2
(45) Date of Patent: May 28, 2019

(54) BRIGHTNESS CONTROL ARCHITECTURE

(71) Applicant: Apple Inc., Cupertino, CA (US)

(72) Inventors: Koorosh Aflatooni, Los Altos Hills, CA (US); Sang Y. Youn, Cupertino, CA (US); Mohammad Hajirostam, San Jose, CA (US); Yun Wang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 96 days.

(21) Appl. No.: 15/347,611

(22) Filed: Nov. 9, 2016

(65) Prior Publication Data

US 2018/0061366 A1 Mar. 1, 2018

Related U.S. Application Data

(60) Provisional application No. 62/381,898, filed on Aug. 31, 2016.

(51) Int. Cl.
*G09G 3/32* (2016.01)
*G09G 5/10* (2006.01)

(52) U.S. Cl.
CPC ..... *G09G 5/10* (2013.01); *G09G 3/32* (2013.01); *G09G 2300/0809* (2013.01); *G09G 2310/0205* (2013.01); *G09G 2310/0218* (2013.01); *G09G 2310/0267* (2013.01); *G09G 2310/08* (2013.01)

(58) Field of Classification Search
CPC .... G09G 5/10; G09G 3/32; G09G 2310/0205; G09G 2310/0267
See application file for complete search history.

(56) References Cited

U.S. PATENT DOCUMENTS

| | | | | |
|---|---|---|---|---|
| 7,663,691 | B2 | 2/2010 | Cuidad et al. | |
| 7,876,299 | B2 | 1/2011 | Bolotski | |
| 8,797,441 | B2 | 8/2014 | Patel | |
| 9,380,194 | B2 | 6/2016 | Thimmappa et al. | |
| 2004/0239799 | A1 | 12/2004 | Suzuki et al. | |
| 2013/0050233 | A1 | 2/2013 | Hirsch | |
| 2013/0100173 | A1 | 4/2013 | Chaji et al. | |
| 2014/0232955 | A1 | 8/2014 | Roudbari et al. | |
| 2014/0285699 | A1 | 9/2014 | Kato | |
| 2015/0201130 | A1 | 7/2015 | Cho et al. | |
| 2015/0364078 | A1* | 12/2015 | Shim | G09G 3/2092 345/211 |

* cited by examiner

*Primary Examiner* — Michael Pervan
(74) *Attorney, Agent, or Firm* — Jaffery Watson Mendonsa & Hamilton LLP

(57) ABSTRACT

Display panels and methods for operating a display panel are described. In an embodiment, the display panel includes a plurality of pixels arranged in rows and columns, a plurality of rows of emission control lines extending through the plurality of rows of pixels, and a global emission line coupled to the plurality of rows of emission control lines. Modes of operation of the display panel include global flash mode and low persistence mode.

7 Claims, 12 Drawing Sheets

BRIGHTNESS CONTROL ARCHITECTURE

RELATED APPLICATIONS

This application claims the benefit of priority of U.S. Provisional Application No. 62/381,898 filed Aug. 31, 2016, which is incorporated herein by reference.

BACKGROUND

Field

Embodiments described herein relate to display systems. More particular, embodiments describe display panels and methods for operating display panels with global emission.

Background Information

Cameras commonly include a light source to produce a flash of artificial light for illumination of a target object. Typically a flash is built into a camera as a separate unit. Many mobile devices, such as camera phones, or smart phones, now commonly include a camera and separate flash, in addition to a display panel. More recently display devices have been introduced in which the display panel can be utilized as the flash source, which may eliminate the need for a separate flash unit.

SUMMARY

Embodiments describe display systems and methods of operation. In an embodiment, a display panel includes a plurality of pixels arranged in rows and columns, a plurality of rows of emission control lines extending through the plurality of rows of pixels; and a global emission line coupled to the plurality of rows of emission control lines. In an embodiment, a plurality of global emission switches couple the global emission line to the plurality of rows of emission control lines. In an embodiment, a plurality of rows of gate write lines extend through the plurality of rows of pixels, and a plurality of rows of gate initialization lines extend through the plurality of rows of pixels. A global auxiliary gate line may be coupled to the plurality of rows of gate write lines and the plurality of rows of gate initialization lines by a plurality of auxiliary gate switches. In an embodiment, a global gate initialization line is coupled to the plurality of rows of gate initialization lines by a plurality of global gate initialization switches.

The display panel may additionally include a first global gate write line and a second global gate write line. For example, the first global gate write line may be coupled to odd rows of the plurality of rows of gate write lines, while the second global gate write line is coupled to even rows of the plurality of rows of gate write lines. A first plurality of gate write switches may couple the first global gate write line to the odd rows of the plurality of rows of gate write lines, and a second plurality of gate write switches may couple the second global gate write line to the even rows of the plurality of rows of gate write lines.

In an embodiment, the plurality of global emission switches, the plurality of gate write switches, the plurality of auxiliary gate switches, and the plurality of global gate initialization switches are included in a gate in panel. Each of the switches may include a thin film transistor.

The display systems and panels in accordance with embodiments may be operated in global emission modes, such as a global flash mode or in a low persistence mode. In an embodiment, a method of operating a display panel in a global flash mode includes applying an auxiliary gate line signal to a global auxiliary gate line coupled to a plurality of rows of gate write lines and a plurality of rows of gate initialization lines to disable a daisy chain between the plurality of rows of gate write lines and a plurality of rows of gate initialization lines; applying a global gate write signal to a global gate write line coupled to a plurality of rows of gate write lines; and applying a global emission signal to global emission line coupled to the plurality of rows of emission control lines.

The global flash mode method of operation may additionally include applying a global gate initialization signal to a global gate initialization line coupled to the plurality of rows of gate initialization lines prior to applying the global gate write signal. Gate write signals may also by applied to the display panel row-by-row prior to applying the auxiliary gate line signal. In an embodiment, the auxiliary gate line signal is applied to the global auxiliary gate line while applying the global gate initialization signal, while applying the global gate write signal, and while applying the global emission signal. In an embodiment, the global gate write signal is applied to the global gate write line coupled to plurality of odd rows of the plurality of rows of gate write lines, and a second global gate write signal is applied to a second global gate write line coupled to a plurality of even rows of the plurality of rows of gate write lines.

In an embodiment, a method of operating a display panel in a low persistence mode includes applying a normal operation signal to a global emission line coupled to the plurality of rows of emission control lines to allow application of local emission signals to the plurality of rows of emission control lines; applying write signals to a plurality of rows of gate write lines; and applying a global emission signal to the global emission line coupled to the plurality of rows of emission control lines. In an embodiment, the write signals are applied to the plurality of rows of gate write lines comprises sequentially. In an embodiment, gate initialization signals are sequentially applied to a plurality of rows of gate initialization lines prior to applying the write signals to the plurality of rows of gate write lines.

DETAILED DESCRIPTION

Embodiments describe display systems and methods for operating a display panel, such as in a global flash mode or in a low persistence mode. In an embodiment, a display includes a plurality of pixels arranged in rows and columns. A plurality of rows of emission control lines extend through the plurality of rows of pixels, and a global emission line is coupled to the plurality of rows of emission control lines.

In an embodiment, a normal operation signal is applied to a global emission line coupled to a plurality of rows of emission control lines to allow application of local emission signals to the plurality of rows of emission control lines. Write signals may then be applied to a plurality of rows of gate write lines, followed by the application of a global emission signal to the global emission line in order to cause global emission of the plurality of pixels in the display panel. Such a method of operation may be compatible with low persistence mode operation, as well as global flash mode operation. Additional structure may be included modes operation in accordance with embodiments such as a global data voltage source, global emission switches, a global auxiliary gate line and switches, global gate initialization line and switches, and one or more global gate write lines and switches.

In various embodiments, description is made with reference to figures. However, certain embodiments may be practiced without one or more of these specific details, or in combination with other known methods and configurations. In the following description, numerous specific details are set forth, such as specific configurations, dimensions and processes, etc., in order to provide a thorough understanding of the embodiments. In other instances, well-known semiconductor processes and manufacturing techniques have not been described in particular detail in order to not unnecessarily obscure the embodiments. Reference throughout this specification to "one embodiment" means that a particular feature, structure, configuration, or characteristic described in connection with the embodiment is included in at least one embodiment. Thus, the appearances of the phrase "in one embodiment" in various places throughout this specification are not necessarily referring to the same embodiment. Furthermore, the particular features, structures, configurations, or characteristics may be combined in any suitable manner in one or more embodiments.

Figure 1:
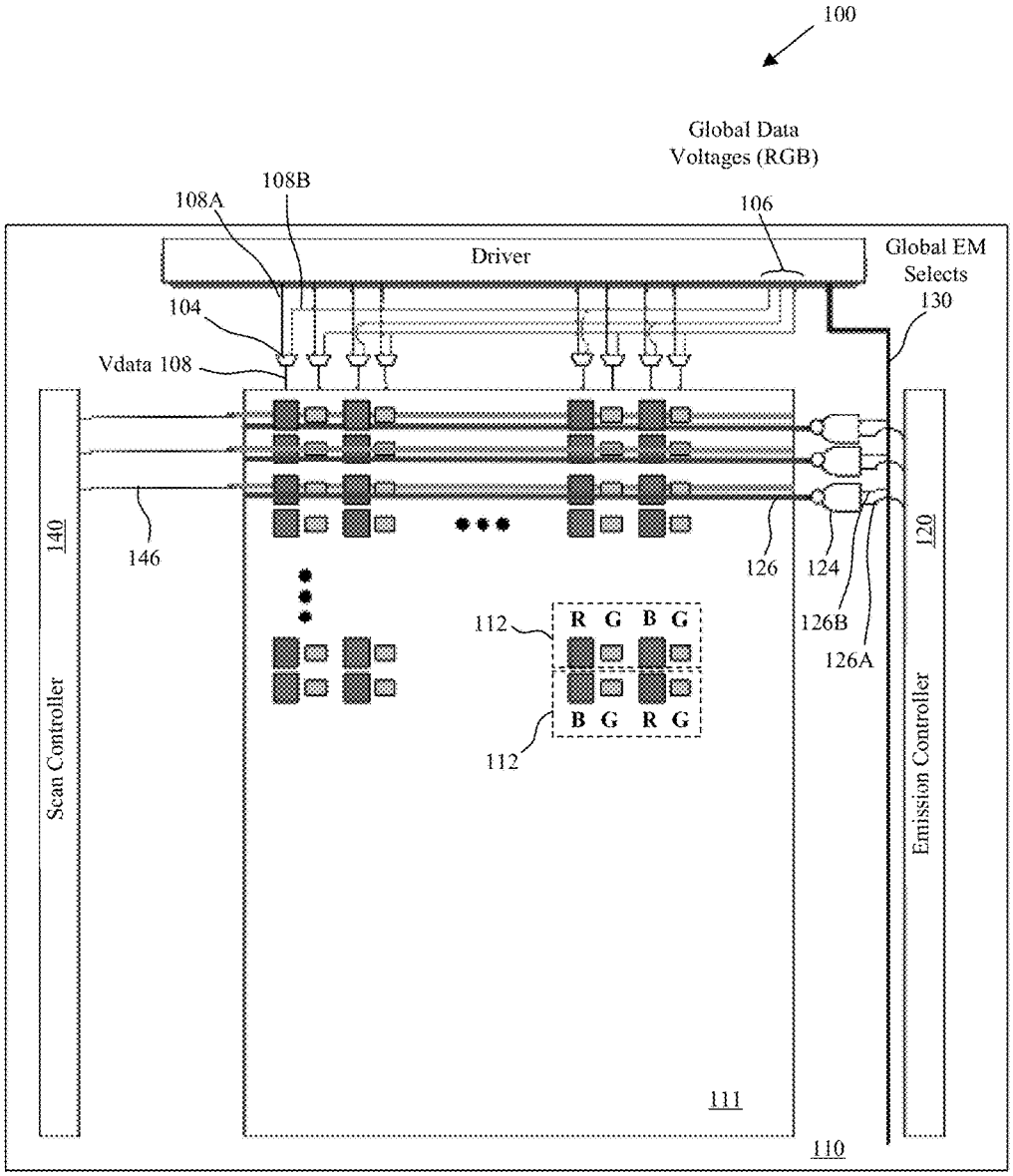
FIG. 1 is a schematic system level view of a display panel including a global emission select line in accordance with an embodiment.

Referring now to FIG. 1 a schematic system level view is provided of a display panel 100 including a global emission select line 130 in accordance with an embodiment. As illustrated, the display panel 100 includes a display substrate 110 and a plurality of pixels 112 arranged in rows and columns within a display area 111. Each pixel 112 may include a variety of arrangements of subpixels. In the particular embodiment illustrated the pixel arrangement is a Pentile™ arrangement including red-green-blue-green emitting subpixels in odd rows, with blue-green-red-green emitting subpixels in adjacent even rows. It is to be appreciated that such a pixel arrangement is exemplary, and embodiments are not so limited.

The display panel 100 includes additional components commonly found in display systems such as a source driver 102, for applying data signals (Vdata) to the array of pixels 112 by way of multiplexers 104 and data lines 108; a scan controller 140 for sending data write signals (also referred to as scan or select signals) to the array of pixels 112 by way of gate write lines 142 (also referred to as scan lines, select lines), and an emission controller 120 for sending emission control signals to the array of pixels 112 by way of emission control lines 122.

In accordance with embodiments, the display panel may further include a global data voltage source 106 which can be used to input data by a specified global amount. As shown in FIG. 1, the local data line connections 108A (for normal display mode operation) and global data line connections 108B are input to the multiplexers 104 for selection of local data or global data signal application to the pixels 112.

In accordance with embodiments, the display panel 100 may further include a global emission select line 130 coupled to a plurality of rows of emission control lines 126 that extend across a plurality of rows of pixels 112. The global emission select signal may be provided by the source driver 102 in some embodiments, though this is not required. In an embodiment, a plurality of global emission switches 124 couple the global emission line 130 to the plurality of rows of emission control lines 126. The global emission switches 124 may be formed of a variety of switches, including OR gates, transistors, etc. As shown in FIG. 1, the local emission line connections 126A (for normal display mode operation) and global emission line connections 126B are input to the global emission switches 124 for selection of local emission or global emission signal application to the pixels 112.

Figure 2:
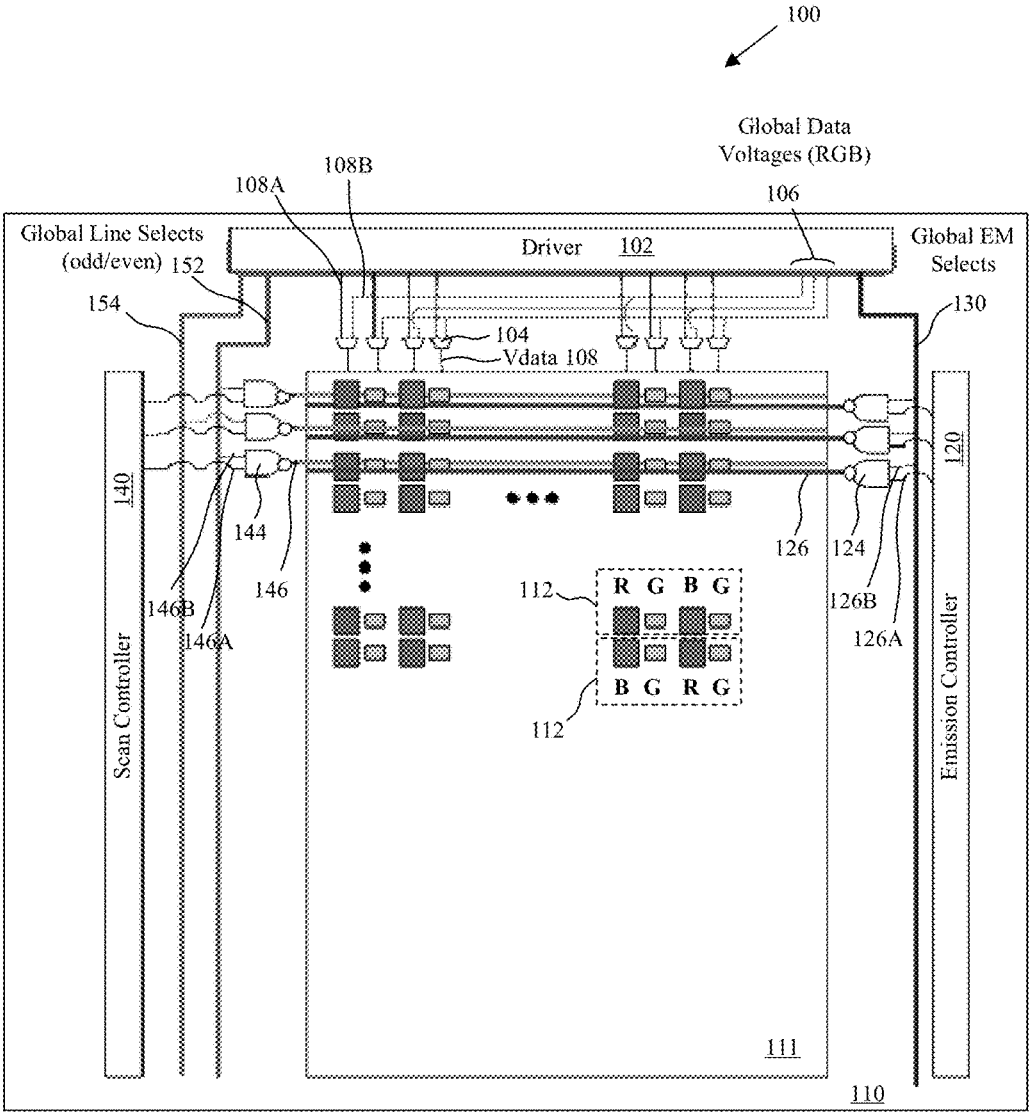
FIGS. 2-3 are schematic system level views of display panels including global row select lines and a global emission select line in accordance with embodiments.

FIG. 2 is a schematic system level view of display panel 100 similar to that illustrated in FIG. 1 with the addition of global gate write lines 152, 154 (also referred to as scan lines, select lines). As shown, a first global gate write line 152 may be coupled to odd rows of the plurality of rows of gate write lines 146 with a first plurality of gate write switches 144, and a second global gate write line 154 may be coupled to even rows of the plurality of rows of gate write lines 146 with a second plurality of gate write switches 144. Additionally, the local row select line connections 146A (from the scan controller 140) and global row select line connections 146B (from gate write lines 152, 154) are input to the gate write switches 144 for selection of local gate write or global gate write signal application to the pixels 112.

Figure 3:
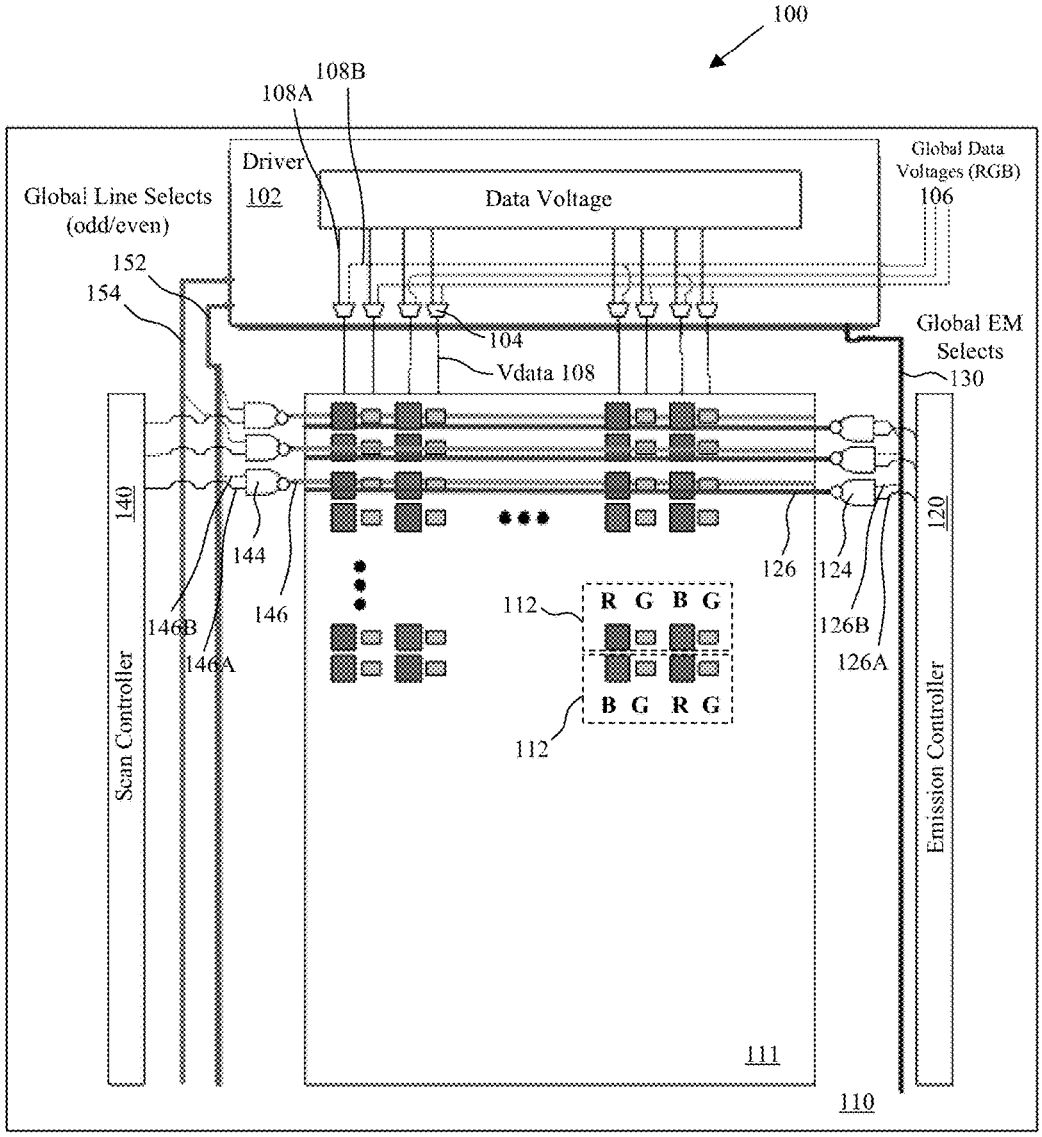

Referring now to FIG. 3 a schematic system level view of display panel 100 is provided similar to that illustrated in FIG. 2 with one difference being location of the plurality of multiplexers 104 within the source driver 102, and global data voltage source 106 outside of the source driver 102. A variety of alternative arrangements are possible, and embodiments are not limited to the configurations illustrated in FIGS. 1-3. For example, the scan controller 140 and emission controller 120 can be located off of the display substrate 110, for example, on a flex circuit.

Figure 4:
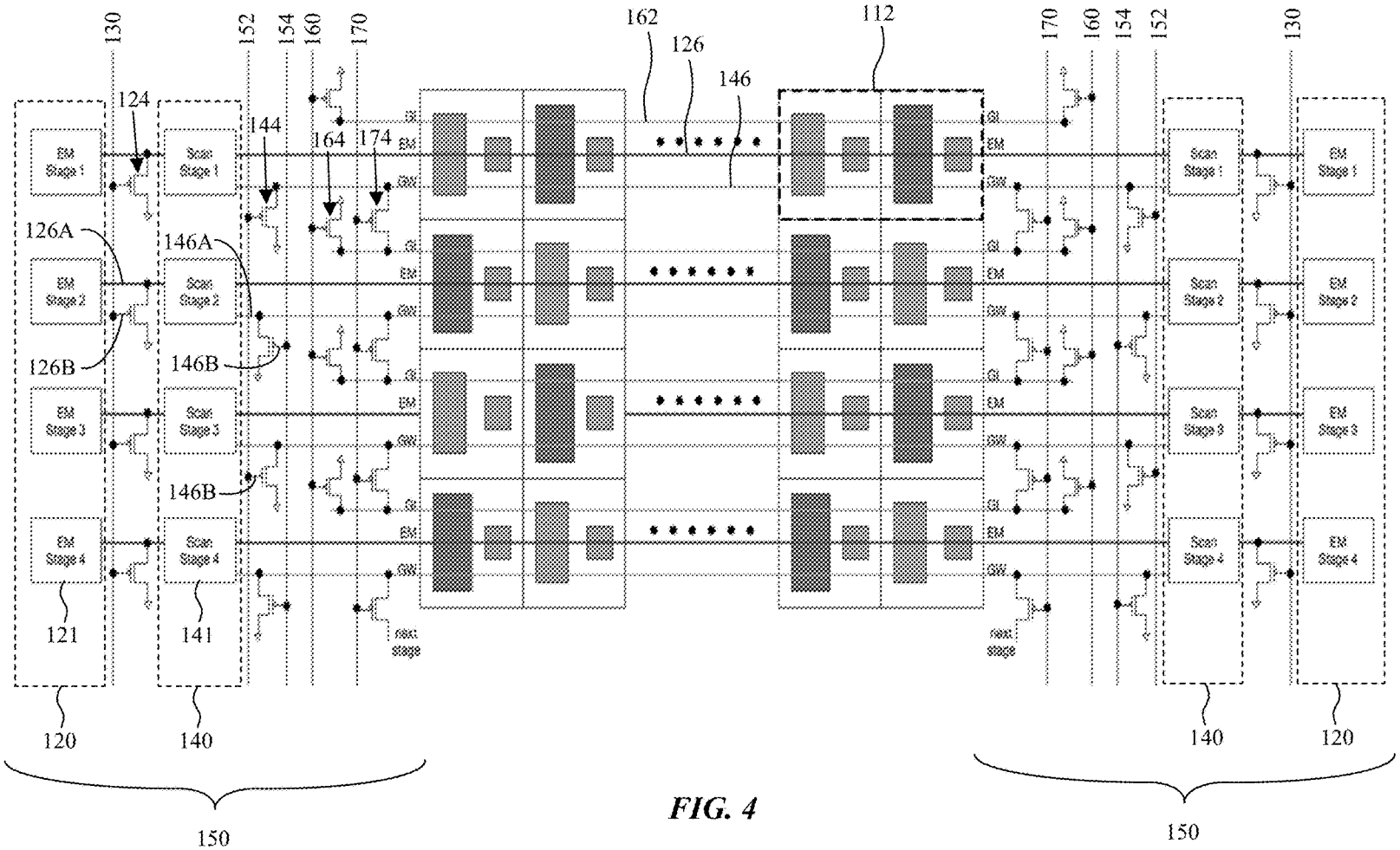
FIG. 4 is a schematic close up view of a gate in panel layout in accordance with an embodiment.

FIG. 4 is a schematic close up view of a gate in panel (GIP) 150 layout in accordance with an embodiment. A first distinction that is drawn when compared to FIGS. 1-3 is that the scan controller 140 and emission controller 120 may be located on both sides of the rows of pixels. While FIGS. 1-3 illustrated a scan controller 140 and emission controller 120 on opposite sides, this is not required. Each emission controller 120 may include a plurality of shift registers 121, and each scan controller 140 may include a plurality of shift registers 141. For example, each GIP 150 may include a shift register 121, 141 for each row of pixels.

In the particular embodiment illustrated in FIG. 4, a local emission line connection 126A (for normal display mode operation) is made between a global emission switch 124 and the shift register 121 of the emission controller 120. A global emission line connection 126B (for global display operation) is made between the global emission switch 124 and the global emission line 130. The rows of emission control lines 126 are then routed through the rows of pixels 112. In operation, the global emission switches 124 may be utilized to globally switch between normal operation and global emission of the display panel. In the particular embodiment illustrated in FIG. 4, the global emission switches 124 are PMOS transistors. Application of a high voltage signal (normal operation signal) through the global emission line 130 pulls the PMOS transistors to high gate voltage (Vg high), and turns the PMOS transistor OFF. This allows normal operation of the display panel by emission controller 120 and shift registers 121. Similarly, application of a low voltage signal (global emission signal) through the global emission line 130 pulls the PMOS transistors to a low gate voltage (Vg low), which turns the PMOS transistor ON and enables global emission. It is to be appreciated that implementation of PMOS transistors is exemplary, and embodiments are not so limited. For example, NMOS transistors or CMOS may also be used.

Still referring to FIG. 4, local row select line connection 146A (for normal display mode operation) is made between a gate write switch 144 and the shift register 141 of the scan controller 140. A global row select line connection 146B is made between the gate write switch 144 and a global gate write line 152 (odd rows) or global gate write line 154 (even rows). The rows of gate write lines 146 are then routed through the rows of pixels 112. Such an arrangement of global gate write lines 152, 154 may be particular to a pixel layout such as the Pentile™ pixel layout in which the subpixels are arranged differently in odd and even rows. In other embodiments, the pixels may be uniform across the panel, and a single global gate write line may suffice.

In operation, the global gate write lines 152, 154 may be utilized to globally write to the pixels across rows of the display panel. In the particular embodiment illustrated in FIG. 4, the global gate write switches 144 are PMOS transistors. Application of a low voltage signal through the global gate write lines 152, 154 enables global writing to the odd and even rows of pixels.

In accordance with embodiments, the display panel 100 may additionally include a plurality of rows of gate initialization lines 162 extending through the rows of pixels 112, and a global gate initialization line 160 coupled to the plurality of rows of gate initialization lines 162 with a plurality of global gate initialization switches 164. In operation, the global gate initialization line 160 may be utilized to globally initialize the gate nodes of the drive transistors for each subpixel in the display. In the particular embodiment illustrated in FIG. 4, the global gate initialization switches 164 are PMOS transistors. Application of a low voltage signal through the global gate initialization line 160 enables setting the nodes of the drive transistors to a known voltage value for repeatable performance.

Figure 5:
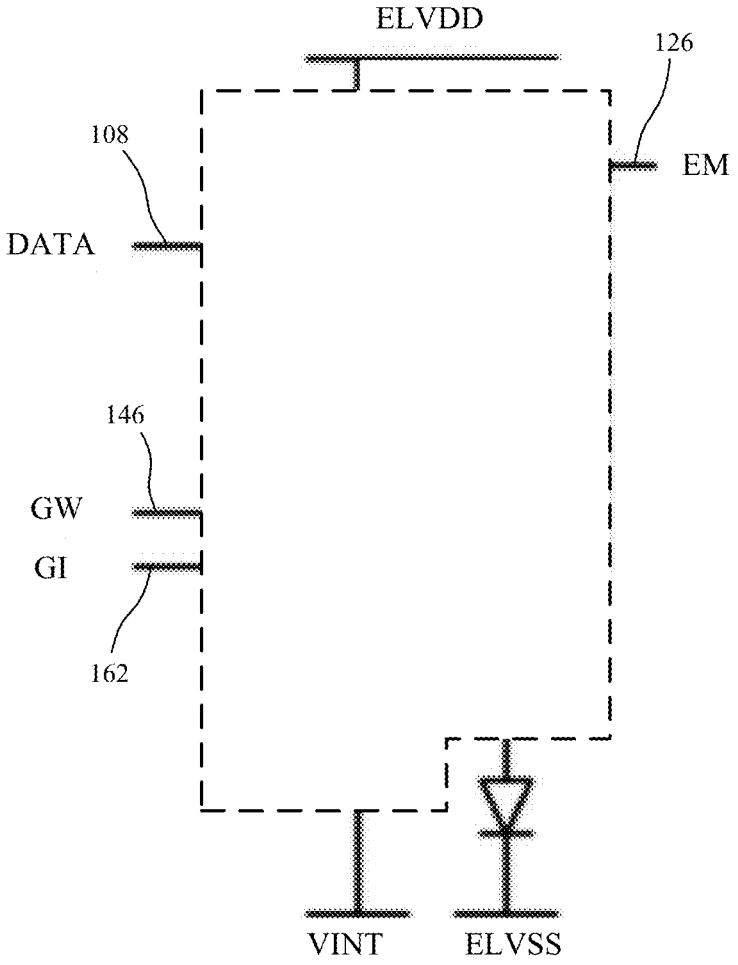
FIG. 5 is a pixel circuit diagram illustrating signal input lines in accordance with embodiments.

The display panel 100 may additionally include a global auxiliary gate line 170 coupled to the plurality of rows of gate write lines 146 and the plurality of rows of gate initialization lines 162 with a plurality of auxiliary gate switches 174. Referring briefly to FIG. 5, an exemplary subpixel circuit is provided to illustrate signal inputs to a subpixel during operation of the display panel 100. For example, data (DATA, Vdata) signals may be input from data lines 108, gate write (GW) signals may be input from the gate write lines 146, gate initialization (GI) signals may be input from the gate initialization lines 162, and emission control (EM) signals may be input from the emission control lines 126. A remainder of the pixel circuit is illustrated by an empty box to illustrate both a conventional pixel circuit and also that a variety of pixel circuits are possible in accordance with embodiments, which commonly include a drive transistor, selection transistor, storage capacitor, etc. In accordance with embodiments, normal display operation may include writing data to the display pixels one row at a time, sequentially. In such a mode of operation, while data is being written to the display pixels within one row (e.g., during application of the data (DATA, Vdata) signals and gate write (GW) signals), the below row is receiving a gate initialization (GI) signal to initialize the gate nodes of the drive transistors within the below row to a known voltage value. This connection is referred to as a daisy chain connection between the gate write lines 146 (e.g. in an odd row of pixels) and the gate initialization lines 162 in the next row of pixels (e.g. in an even row of pixels below the odd row of pixels). Referring again to FIG. 4, in accordance with embodiments, a global auxiliary gate line signal may be applied to the global auxiliary gate line 170. In some embodiments, this disables daisy chain connections between the plurality of rows of gate write lines 146 and the plurality of rows of gate initialization lines 162. In this aspect, application of the global auxiliary gate line signal allows data to be written to the pixels along the odd rows of gate write lines 146 without initializing the adjacent pixels along the even rows of gate write lines 146, and vice versa.

Still referring to FIG. 4, the plurality of global emission switches 124, the plurality of gate write switches 144, the plurality of auxiliary gate switches 174, and the plurality of global gate initialization switches 164 are included in a gate in panel (GIP) 150. For example, the GIP may be formed in the display substrate 110, such as along the lateral sides of the display substrate. In an embodiment, the switches 124, 144, 164, 174 each include one or more thin film transistors. In other embodiments, the GIP may be located off of the display substrate 110, such as on a flex circuit.

Figure 6:
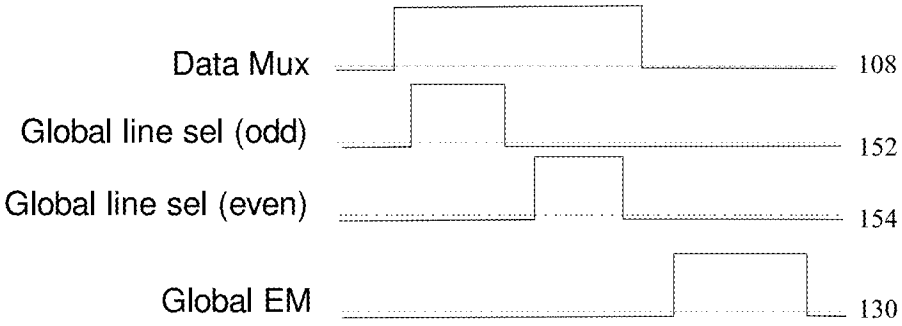
FIGS. 6-7 are timing diagrams for global emission in accordance with embodiments.

Referring now to FIG. 6 a timing diagram is provided for global emission in accordance with embodiments. For example, the timing diagram may be used for a global flash mode operation of the display panel. Global data signals (DATA, Vdata) are sent to the pixels by way of global data voltage source 106, multiplexers 104 and data lines (Vdata) 108 as a first global gate write (GW) signal is applied to the pixels through global gate write line 152 that is coupled to a plurality of odd rows of gate write lines 146, and a second global gate write (GW) signal is applied to the pixels through global gate write line 154 that is coupled to a plurality of even rows of gate write lines 146. Application of the data signals (DATA, Vdata) and global gate write (GW) signals may then be stopped, and a global emission (EM) signal may then be applied to the global emission line 130 that is coupled to the plurality of rows of emission control lines 126. For example, application of the global emission signal may include switching from application of a normal operation signal to the global emission line 130 to the global emission signal, and then returning to the normal operation signal at the end of the global flash period. Brightness of the global flash may be related to the values of the voltages of the global data signals (DATA, Vdata) and global gate write (GW) signals applied to the even and odd rows. Thus, brightness of the even and odd rows may be independently controlled to adjust total panel brightness in global flash mode. In some embodiments, brightness of the even and odd rows is different.

Figure 7:
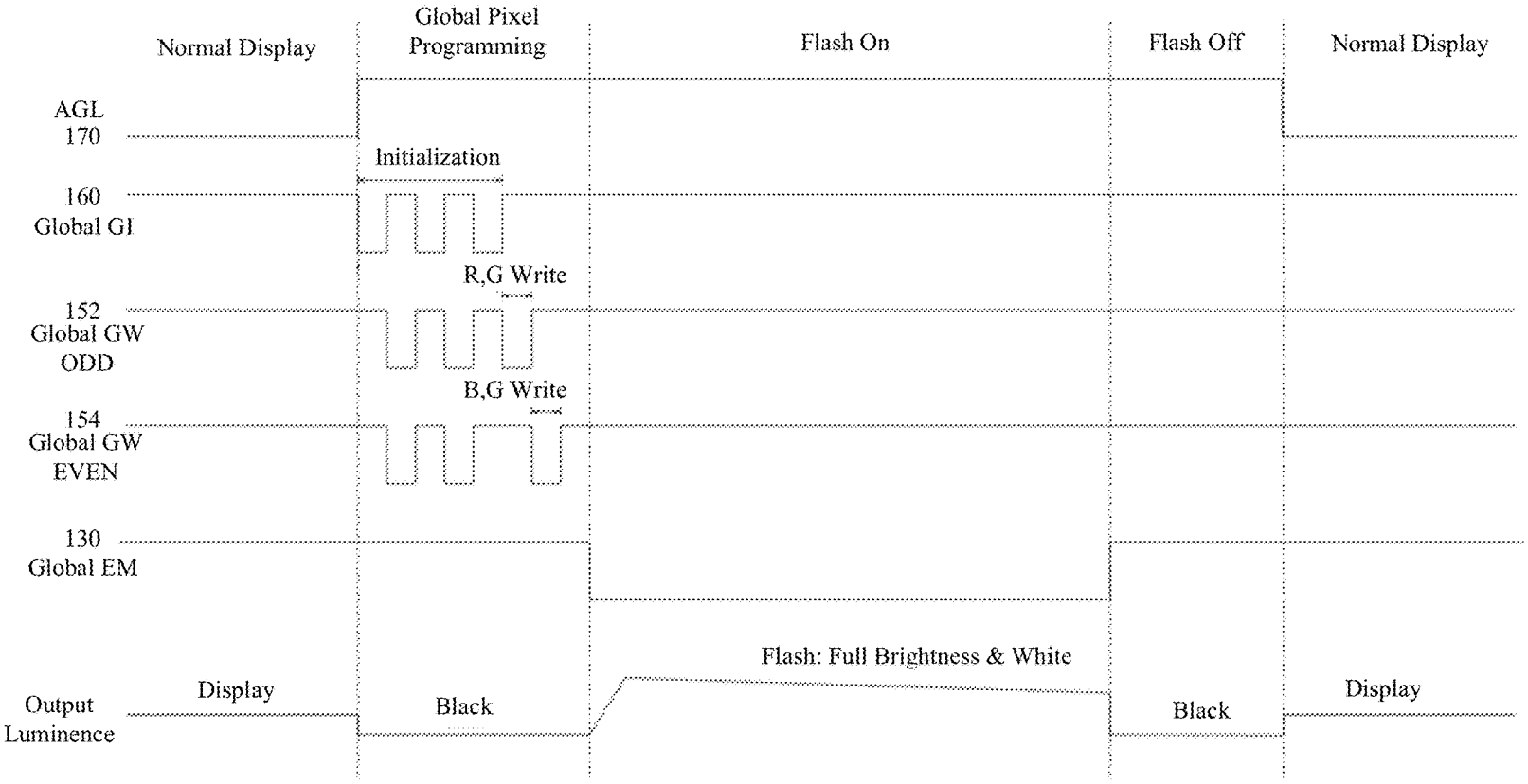

Referring now to FIG. 7 another timing diagram is provided for global emission in accordance with embodiments. As shown, the timing diagram illustration includes periods of normal display operation, global pixel programming, global flash on, global flash off, and normal display operation. In interests of convenience, description of FIG. 7 is made concurrently with the description of the flow charts illustrated in FIGS. 8-9. For example, the flow chart illustrated in FIG. 8 may be particularly applicable to pixel arrangements that are different within odd and even rows, while the flow chart illustrated in FIG. 9 may be applicable to a variety of different pixel arrangements.

Prior to enabling global emission, the display panel may be operating in normal mode, and a normal emission signal may be applied to the global emission line 130 so that emission of the display panel is controlled by emission controller 120 and shift registers 121. Thus, local emission signals may be applied by the shift registers 121 to the plurality of rows of emission control lines 126 through local emission line connections 126A. A global auxiliary gate line (AGL) signal may be applied to the global auxiliary gate line 170 to disable the daisy chain connections between the plurality of rows of gate write lines 146 and the plurality of rows of gate initialization lines 162. In an embodiment, the global auxiliary gate line signal is applied at the same time as applying the normal emission signal to the global emission line 130. A global gate initialization (GI) signal may then be applied to the global gate initialization line 160 that is coupled to the plurality of rows of gate initialization lies 162 to initialized the pixel circuits for global pixel programming. For example, the global GI signal may be applied at the same time as the global AGL signal.

At operation 810 a global gate write (GW) signal is applied to a first global gate write line 152 that is coupled to a plurality of odd gate write lines 146 and at operation 820 a global gate write (GW) signal is applied to a second global gate write line 154 that is coupled to a plurality of even gate write lines 146. Operations 810, 820 may be performed sequentially, in reverse order, or simultaneously. At operation 830 a global emission (EM) signal is applied to the global emission line 130 that is coupled to a plurality of rows of emission control lines 126.

Figure 9:
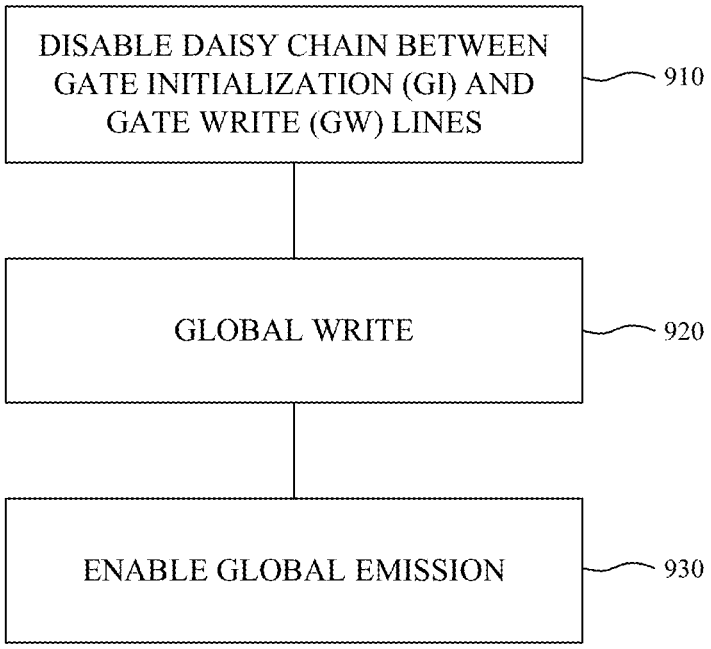

Referring now to FIG. 9, in the embodiment illustrated at operation 910 a daisy chain between gate initialization lines and gate write lines is disabled. For example, this may be effected by applying an auxiliary gate line signal to a global auxiliary gate line 170 coupled to a plurality of rows of gate write lines 146 and a plurality of rows of gate initialization lines 162 to disable the daisy chain between the plurality of rows of gate write lines 146 and a plurality of rows of gate initialization lines 162. At operation 920 a global gate write (GW) signal is applied to one or more global gate write lines 152, 154 that is coupled to a plurality of gate write lines 146. At operation 940 a global emission (EM) signal is applied to the global emission line 130 that is coupled to a plurality of rows of emission control lines 126.

Figure 8:
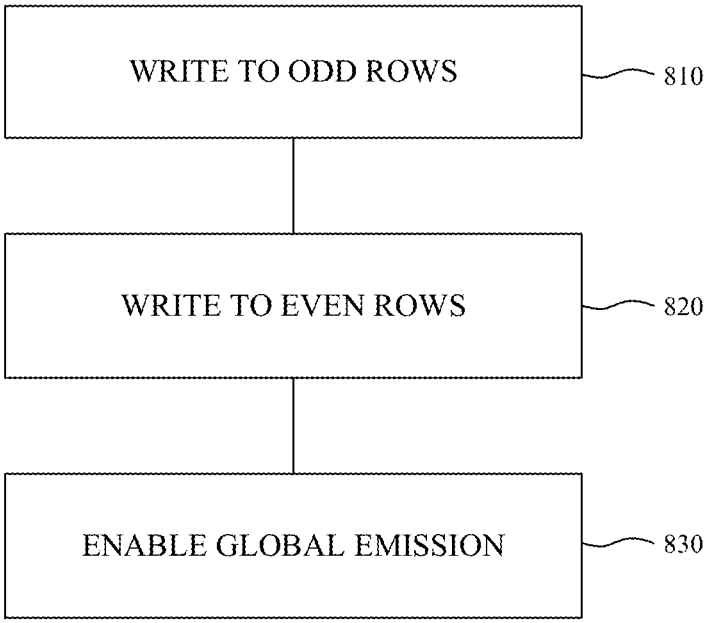
FIGS. 8-9 are flow charts illustrating methods of operating a display panel in global flash mode in accordance with embodiments.

As shown in FIG. 7 a variety of additional operations may be formed during the sequences illustrated in FIGS. 7-8. For example, a global gate initialization signal may be applied to a global gate initialization line (160) coupled to the plurality of rows of gate initialization lines (162) prior to applying the global gate write signal(s). In an embodiment, an auxiliary gate line signal is applied to the global auxiliary gate line 170 while applying the global gate initialization signal, while applying the global gate write signal, and while applying the global emission signal. In an embodiment, the global gate write signal is applied to the global gate write line 152 coupled to plurality of odd rows of the plurality of rows of gate write lines 146, and a second global gate write signal is applied to a second global gate write line 154 coupled to a plurality of even rows of the plurality of rows of gate write lines 146. In an embodiment, a normal emission signal may be applied to the global emission line 130 at any time the global emission signal is not applied to the global emission line 130.

Figure 10:
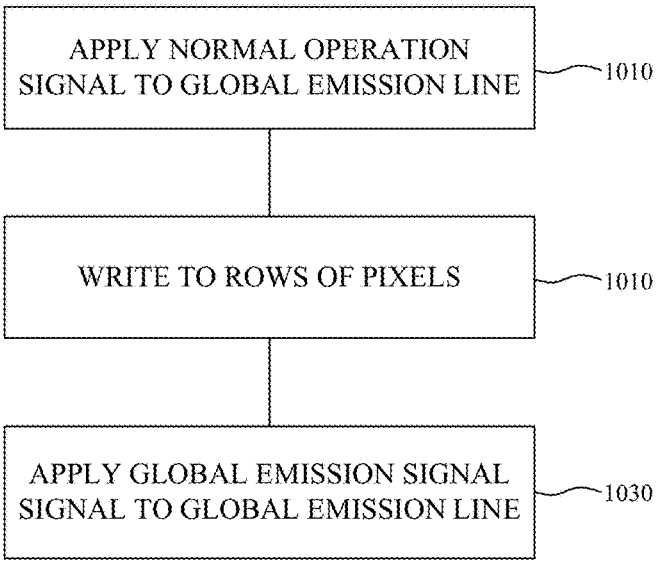
FIG. 10 is a flow chart illustrating a method of operating a display panel in low persistence mode in accordance with an embodiment.

FIG. 10 is a flow chart illustrating a method of operating a display panel in low persistence mode in accordance with an embodiment. In one aspect, embodiments including a global emission line 130 coupled to the plurality of rows of emission control lines and a global data voltage source 106 may be used for operation of the display panel in a low persistence mode, for example, to avoid motion artifacts. In a low persistence mode the emission pulse is controlled globally and turned on for a programmable amount of time. The emission is invoked after the display update, which may be made under normal operating conditions (e.g. sequentially row-by-row), and terminated before a new frame begins updating.

In an embodiment, at operation 1010 a normal operation signal is applied to a global emission line 130 coupled to the plurality of rows of emission control lines 126 to allow normal operation of the display panel, for example by emission controller 120 and shift registers 121. At operation 1020 write signals are applied to a plurality of rows of gate write lines 146. At operation 1030 a global emission signal is applied to the global emission line 130 coupled to the plurality of rows of emission control lines 126. In an embodiment, applying the write signals are applied sequentially (e.g. row-by-row) to the plurality of rows of gate write lines 146. For example, this may be accompanied by applying local Vdata (DATA) signals from local data line connections 108A (for normal display mode operation). In an embodiment, gate initialization signals are sequentially applied to a plurality of rows of gate initialization lines 162 prior to applying the write signals to the plurality of rows of gate write lines 146.

Figure 11:
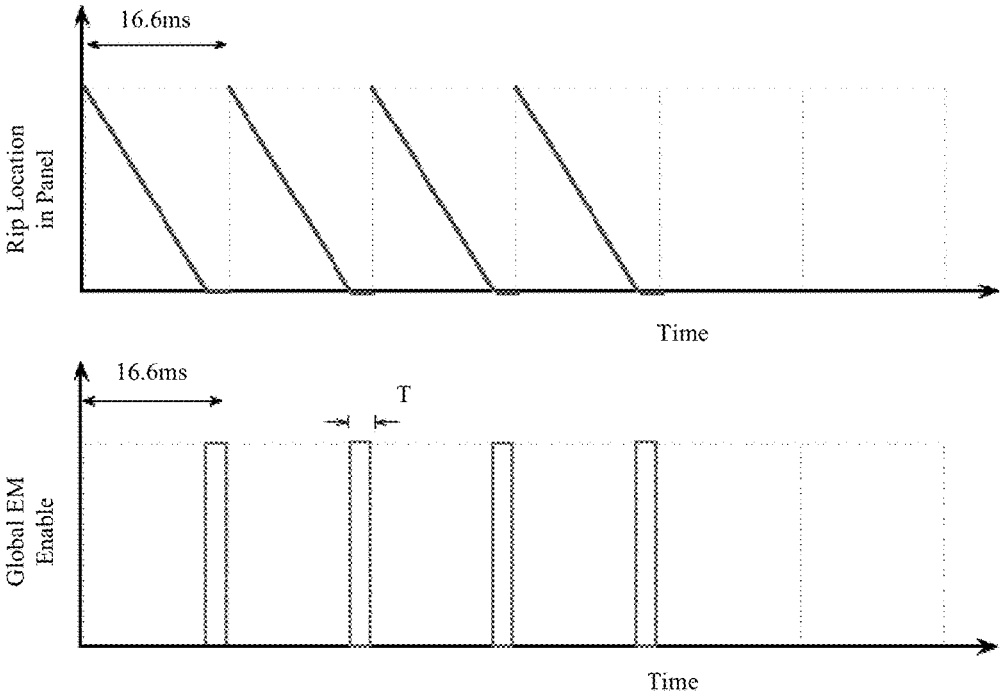
FIG. 11 is an illustration of a timing diagram of frame times, including time dedicated to sequential application of the write signals, followed by global emission time in accordance with an embodiment

FIG. 11 is an illustration of a timing diagram of frame times, including time dedicated to sequential application of the write signals, followed by global emission time in accordance with an embodiment. As shown, data may be written to the pixels under normal operating conditions, followed by a pulsed global emission.

Figure 12:
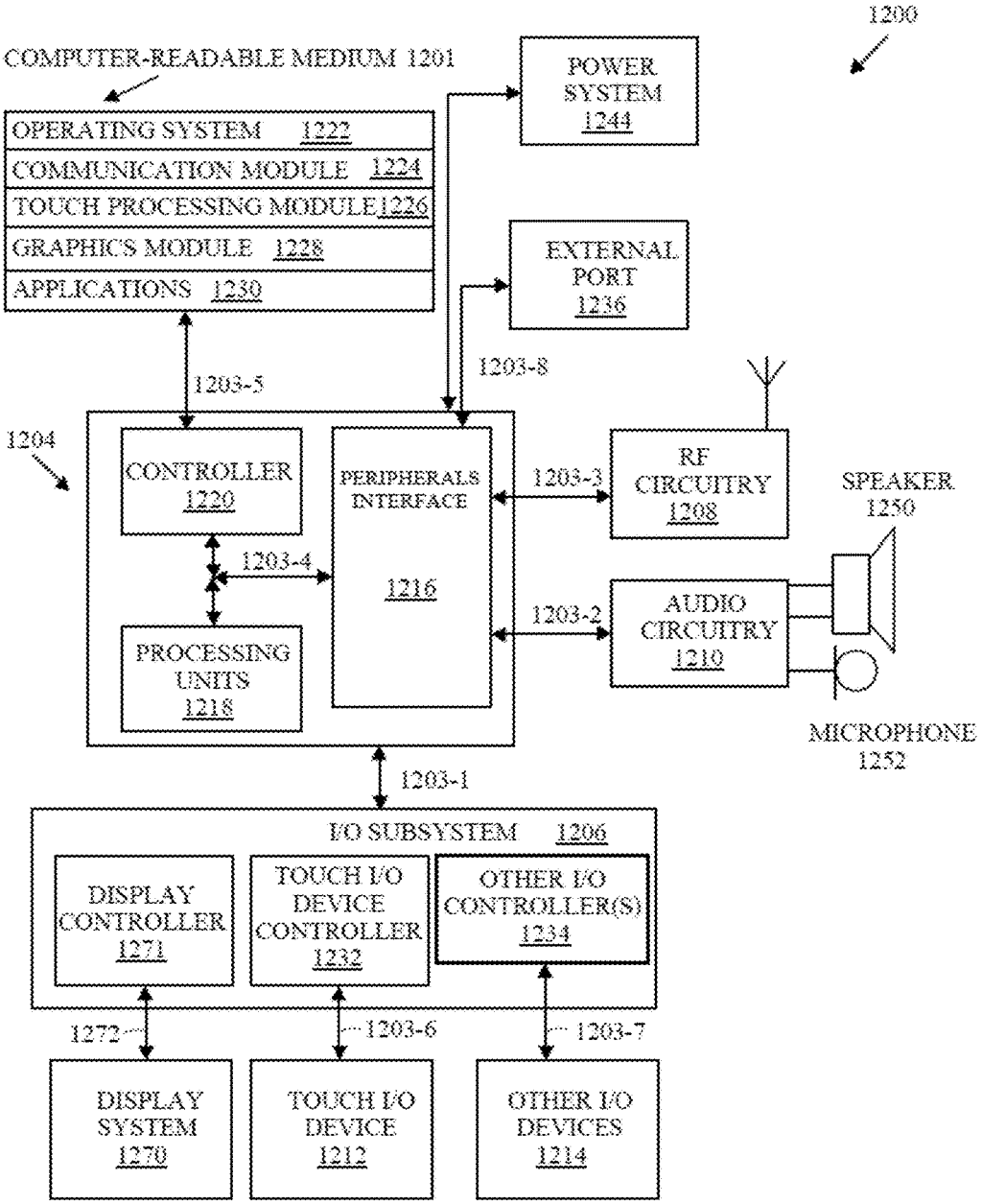
FIG. 12 is a block diagram of one embodiment of a system that generally includes one or more computer-readable mediums, processing system, Input/Output (I/O) subsystem, radio frequency (RF) circuitry and audio circuitry.
Figure 13:
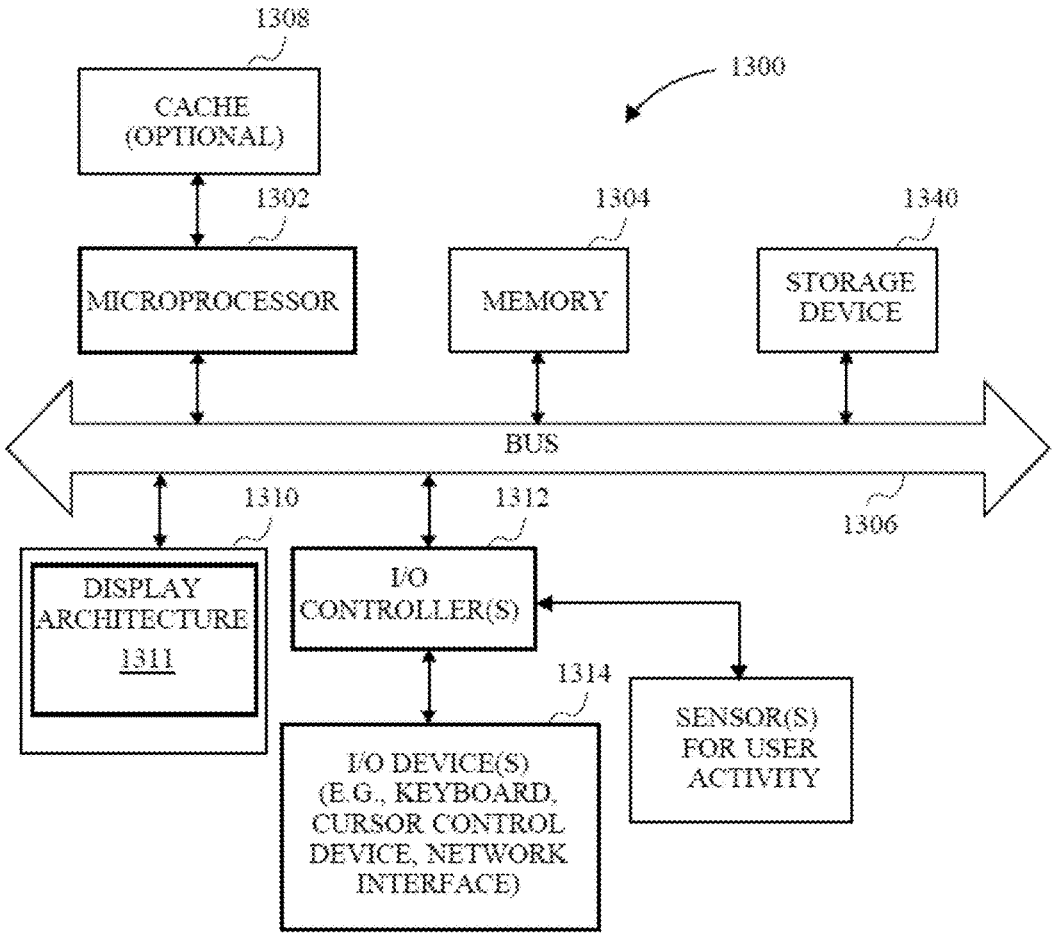
FIG. 13 shows another example of a device according to an embodiment.

In some embodiments, the methods, systems, and apparatuses of the present disclosure can be implemented in various devices including electronic devices, consumer devices, data processing devices, desktop computers, portable computers, wireless devices, cellular devices, tablet devices, display screens, televisions, handheld devices, multi touch devices, multi touch data processing devices, wearable devices, any combination of these devices, or other like devices. FIG. 12 and FIG. 13 illustrate examples of a few of these devices.

Attention is now directed towards embodiments of a system architecture that may be embodied within any portable or non-portable device including but not limited to a communication device (e.g., mobile phone, smart phone, smart watch, wearable device), a multi-media device (e.g., MP3 player, TV, radio), a portable or handheld computer (e.g., tablet, netbook, laptop), a desktop computer, an All-In-One desktop, a peripheral device, a television, or any other system or device adaptable to the inclusion of system architecture 1200, including combinations of two or more of these types of devices.

FIG. 12 is a block diagram of one embodiment of the system 1200 that generally includes one or more computer-readable mediums 1201, processing system 1204, Input/Output (I/O) subsystem 1206, radio frequency (RF) circuitry 1208 and audio circuitry 1210. These components may be coupled by one or more communication buses or signal lines 1203 (e.g., 1203-1, 1203-2, 1203-3, 1203-4, 1203-5, 1203-6, 1203-7, 1208-8).

It should be apparent that the architecture shown in FIG. 12 is only one example architecture of system 1200, and that system 1200 could have more or fewer components than shown, or a different configuration of components. The various components shown in FIG. 12 can be implemented in hardware, software, firmware or any combination thereof, including one or more signal processing and/or application specific integrated circuits.

RF circuitry 1208 is used to send and receive information over a wireless link or network to one or more other devices and includes well-known circuitry for performing this function. RF circuitry 1208 and audio circuitry 1210 are coupled to processing system 1204 via peripherals interface 1216. Interface 1216 includes various known components for establishing and maintaining communication between peripherals and processing system 1204. Audio circuitry 1210 is coupled to audio speaker 1250 and microphone 1252 and includes known circuitry for processing voice signals received from interface 1216 to enable a user to communicate in real-time with other users. In some embodiments, audio circuitry 1210 includes a headphone jack (not shown).

Peripherals interface 1216 couples the input and output peripherals of the system to processing units 1218 and computer-readable medium 1201. One or more processing units 1218 communicate with one or more computer-readable mediums 1201 via controller 1220. Computer-readable medium 1201 can be any device or medium (e.g., storage device, storage medium) that can store code and/or data for use by one or more processing units 1218. Medium 1201 can include a memory hierarchy, including but not limited to cache, main memory and secondary memory. The memory hierarchy can be implemented using any combination of RAM (e.g., SRAM, DRAM, DDRAM), ROM, FLASH, magnetic and/or optical storage devices, such as disk drives, magnetic tape, CDs (compact disks) and DVDs (digital video discs). Medium 1201 may also include a transmission medium for carrying information-bearing signals indicative of computer instructions or data (with or without a carrier wave upon which the signals are modulated). For example, the transmission medium may include a communications network, including but not limited to the Internet (also referred to as the World Wide Web), intranet(s), Local Area Networks (LANs), Wide Local Area Networks (WLANs), Storage Area Networks (SANs), Metropolitan Area Networks (MAN) and the like.

One or more processing units 1218 run various software components stored in medium 1201 to perform various functions for system 1200. In some embodiments, the software components include operating system 1222, communication module (or set of instructions) 1224, touch processing module (or set of instructions) 1226, graphics module (or set of instructions) 1228, and one or more applications (or set of instructions) 1230. In some embodiments, medium 1201 may store a subset of the modules and data structures identified above. Furthermore, medium 1201 may store additional modules and data structures not described above.

Operating system 1222 includes various procedures, sets of instructions, software components and/or drivers for controlling and managing general system tasks (e.g., memory management, storage device control, power management, etc.) and facilitates communication between various hardware and software components.

Communication module 1224 facilitates communication with other devices over one or more external ports 1236 or via RF circuitry 1208 and includes various software components for handling data received from RF circuitry 1208 and/or external port 1236.

Graphics module 1228 includes various known software components for rendering, animating and displaying graphical objects on a display surface. In embodiments in which touch I/O device 1212 is a touch sensitive display (e.g., touch screen), graphics module 1228 includes components for rendering, displaying, and animating objects on the touch sensitive display. The display architecture (e.g., display panel 100 architecture) of the present design, which may be implemented with display controller 1271 and display system 1270, may be implemented in at least one of the touch I/O device and the touch I/O device controller or may be located as separate components. The display controller and display system are coupled via communication link 1272.

One or more applications 1230 can include any applications installed on system 1200, including without limitation, a game center application, a browser, address book, contact list, email, instant messaging, word processing, keyboard emulation, widgets, JAVA-enabled applications, encryption, digital rights management, voice recognition, voice replication, location determination capability (such as that provided by the global positioning system (GPS)), a music player, etc.

Touch processing module 1226 includes various software components for performing various tasks associated with touch I/O device 1212 including but not limited to receiving and processing touch input received from I/O device 1212 via touch I/O device controller 1232.

FIG. 13 shows another example of a device according to an embodiment of the disclosure. This device 1300 may include one or more processors, such as microprocessor(s) 1302, and a memory 1304, which are coupled to each other through a bus 1306. The device 1300 may optionally include a cache 1308 which is coupled to the microprocessor(s) 1302. The device may optionally include a storage device 1340 which may be, for example, any type of solid-state or magnetic memory device. Storage device 1340 may be or include a machine-readable medium.

This device may also include a display controller and display device 1310 which is coupled to the other components through the bus 1306. The display architecture 1311 (e.g., display panel 100 architecture) of the present design may be implemented in the display controller and display device 1310.

One or more input/output controllers 1312 are also coupled to the bus 1306 to provide an interface for input/output devices 1314 and to provide an interface for one or more sensors 1316 which are for sensing user activity. The bus 1306 may include one or more buses connected to each other through various bridges, controllers, and/or adapters as is well known in the art. The input/output devices 1314 may include a keypad or keyboard or a cursor control device such as a touch input panel. Furthermore, the input/output devices 1314 may include a network interface which is either for a wired network or a wireless network (e.g. an RF transceiver). The sensors 1316 may be any one of the sensors described herein including, for example, a proximity sensor or an ambient light sensor. In at least certain implementations of the device 1300, the microprocessor(s) 1302 may receive data from one or more sensors 1316 and may perform the analysis of that data in the manner described herein.

In certain embodiments of the present disclosure, the device 1300 or device 1200 or combinations of devices 1200 and 1300 can be used to drive display data to a display device and implement at least some of the methods discussed in the present disclosure.

In utilizing the various aspects of the embodiments, it would become apparent to one skilled in the art that combinations or variations of the above embodiments are possible for operating a display panel with global emission. Although the embodiments have been described in language specific to structural features and/or methodological acts, it is to be understood that the appended claims are not necessarily limited to the specific features or acts described. The specific features and acts disclosed are instead to be understood as embodiments of the claims useful for illustration.

What is claimed is:

1. A display panel comprising:

a plurality of pixels arranged in rows and columns;

a plurality of rows of emission control lines extending through the plurality of rows of pixels;

a global emission line coupled to the plurality of rows of emission control lines;

a plurality of global emission switches that couple the global emission line to the plurality of rows of emission control lines;

a plurality of rows of gate write lines extending through the plurality of rows of pixels;

a plurality of rows of gate initialization lines extending through the plurality of rows of pixels; and a global auxiliary gate line coupled to the plurality of rows of gate write lines and the plurality of rows of gate initialization lines with a plurality of auxiliary gate switches.

2. The display panel of claim 1, further comprising a global gate initialization line coupled to the plurality of rows of gate initialization lines.

3. The display panel of claim 2, further comprising a plurality of global gate initialization switches that couple the global gate initialization line to the plurality of rows of gate initialization lines.

4. The display panel of claim 3, further comprising a first global gate write line and a second global gate write line, wherein the first global gate write line is coupled to odd rows of the plurality of rows of gate write lines, and the second global gate write line is coupled to even rows of the plurality of rows of gate write lines.

5. The display panel of claim 4, further comprising a first plurality of gate write switches that couple the first global gate write line to the odd rows of the plurality of rows of gate write lines, and a second plurality of gate write switches that couple the second global gate write line to the even rows of the plurality of rows of gate write lines.

6. The display panel of claim 5, wherein the plurality of global emission switches, the plurality of gate write switches, the plurality of auxiliary gate switches, and the plurality of global gate initialization switches are included in a gate in panel.

7. The display panel of claim 6, wherein the plurality of global emission switches, the plurality of gate write switches, the plurality of auxiliary gate switches, and the plurality of global gate initialization switches each comprise a thin film transistor.

* * * * *